United States Patent [19]

Ruoss et al.

[11] Patent Number: 4,508,551

[45] Date of Patent: Apr. 2, 1985

[54] STEAM DISTRIBUTOR

[75] Inventors: Erwin Ruoss, Münchenstein; Kurt Sieber, Ettingen, both of Switzerland

[73] Assignee: Condair AG, Munchenstein, Switzerland

[21] Appl. No.: 542,365

[22] Filed: Oct. 17, 1983

[30] Foreign Application Priority Data

Oct. 25, 1982 [CH] Switzerland ..... 6212/82

[51] Int. Cl.[3] ..... F24F 6/18

[52] U.S. Cl. ..... 55/263; 55/392; 261/DIG. 76

[58] Field of Search ..... 261/DIG. 76; 55/263, 55/392, 394

[56] References Cited

U.S. PATENT DOCUMENTS

| | | | |
|---|---|---|---|
| 924,587 | 6/1909 | Sharp | 55/392 |
| 1,792,587 | 2/1931 | Jackson | 55/263 |
| 2,949,239 | 8/1960 | Goyette | 261/DIG. 76 |
| 3,923,483 | 12/1975 | Hilmer et al. | 261/DIG. 76 |
| 3,989,483 | 11/1976 | Becker et al. | 55/392 |
| 4,050,630 | 9/1977 | Dupasquier | 261/DIG. 76 |
| 4,384,873 | 5/1983 | Herr | 261/DIG. 76 |

FOREIGN PATENT DOCUMENTS

| | | | |
|---|---|---|---|
| 2748585 | 5/1979 | Fed. Rep. of Germany | 261/DIG. 76 |

*Primary Examiner*—Tim Miles

*Attorney, Agent, or Firm*—Ladas & Parry

[57] ABSTRACT

Located at the bottom edge of the outflow orifice (6) of a steam distributor is a nozzle (10) which extends in the manner of a slit over practically the entire length of the outflow orifice (6). The edges (14, 15) limiting the nozzle orifice (13) laterally are acute-angled and sharp; the inner walls (18, 19) adjoining these edges are designed so that water droplets which possibly form are conveyed away downwards.

Because of the sharp edge design, water droplets cannot form in the outflow region (13) of the nozzle. The outflowing steam which subsequently mixes with an air stream (5) is therefore free of water drops. The formation of water droplets on the inner walls (18, 19) adjoining the said edges is harmless, since these droplets are conveyed away downwards as a result of the inclination of the said walls.

5 Claims, 3 Drawing Figures

STEAM DISTRIBUTOR

The invention relates to a steam distributor which is especially suitable for air humidification systems, with a fan for generating an air stream and with at least one steam nozzle located in the effective range of this air stream and connected to a steam source.

2. As is known, steam distributors of this type are used for distributing as uniformly as possible the steam serving for air humidification in closed rooms. In a known design used most frequently at the present time, the steam is conveyed via a controllable valve into a distributor pipe which has in its upper wall a series of outflow orifices arranged at a distance from one another.

When these known steam distributors are used, it has been shown, especially in relatively small appliances, that the focussing of the steam at the outflow points promotes condensation, in such a way that water drops form on the outflow edges during operation, and as a result of adhesion and surface tension these are retained briefly and then, as soon as they have reached a certain size, are torn off by the steam. However, this "spitting" of the appliance is a highly undesirable accompaniment, since the water droplets settle on the furniture and damage it over a period of time.

The object of the present invention is, therefore, to propose a steam distributor which supplies steam practically free of water droplets.

The invention is defined in the independent patent claim 1. Particular embodiments emerge from the dependent patent claims.

An exemplary embodiment of the subject of the invention is illustrated below with reference to the attached drawing.

Figure 1:
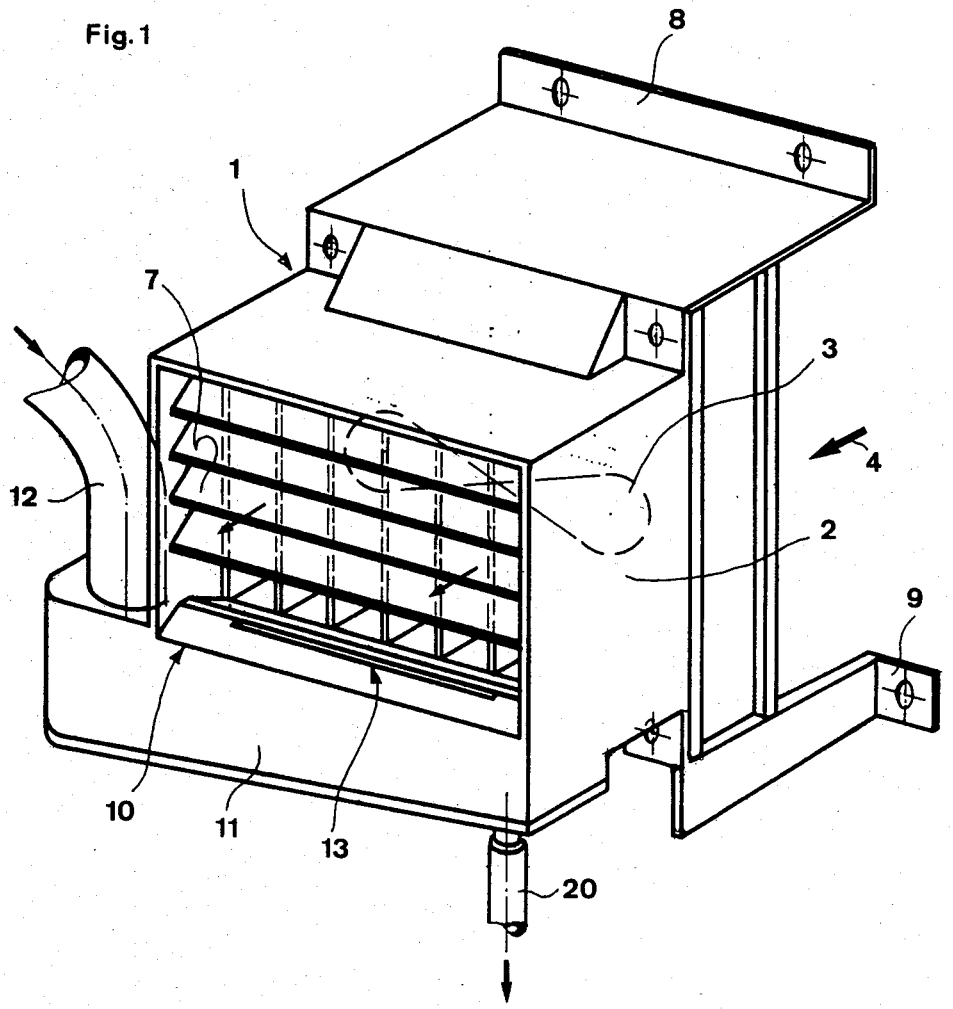
Figure 2:
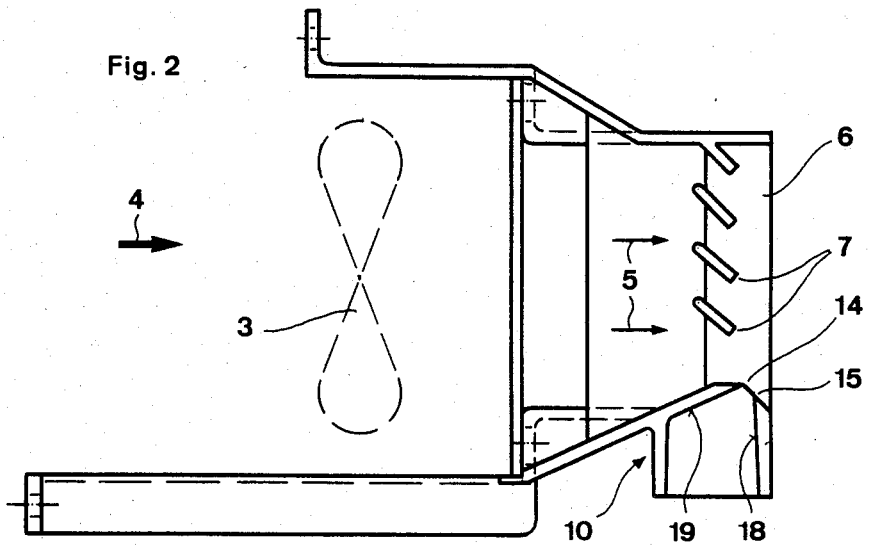
Figure 3:
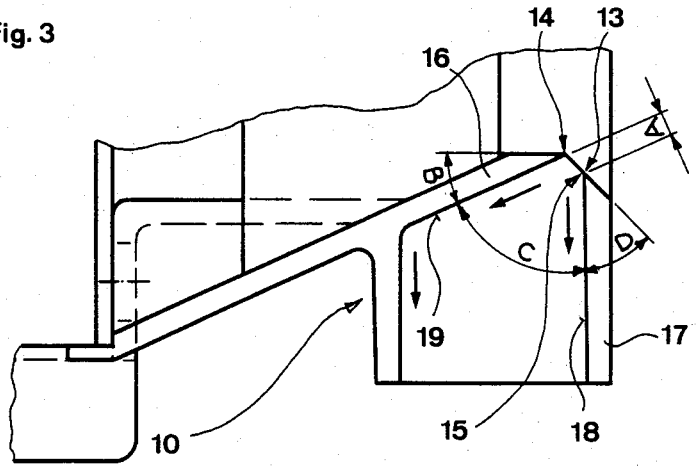

FIG. 1 is a simplified perspective representation of an embodiment of the steam distributor according to the invention, FIG. 2 is a diagrammatic vertical section of this embodiment, and FIG. 3 is an enlarged sectional representation of the nozzle region.

A housing designated as a whole by 1 has a box-shaped basic body 2 within which a fan 3 is arranged. The fan 3 sucks in outer air in the direction of the arrow 4 and conveys it outwards through an outflow orifice 6 in the direction of the arrow 5. Located in the region of the outflow orifice 6 are guide means 7 which give the outflowing air an inclination directed downwards.

The housing 1 can be screwed to a wall by means of flanges 8 and 9.

The lower limitation of the outflow orifice 6 in formed by a nozzle designated as a whole by 10, the slit-shaped orifice 13 of which extends at least over a large part of the outflow orifice and which is connected to a steam line 12 via a buffer tank 11.

The slit-shaped nozzle 10 can be designed either as a single continuous slit or in the form of several slits separated by intermediate webs.

The design of the nozzle 10 which is of decisive importance within the scope of the present invention emerges most clearly from the enlarged sectional representation according to FIG. 3. According to this, the slit 13 of width A is, on the one hand, inclined at an acute angle D relative to the vertical; on the other hand, the slit 13 is limited on its two longitudinally extending limiting edges 14 and 15 by two walls 16 and 17 which end at an acute angle (B and D respectively) in their edge region adjacent to the slit 13, so that the slit 13 is limited on both sides by sharp edges 14 and 15. The inner wall 18 adjoining the outer edge 15 extends vertically, whilst the inner wall 19 adjoining the other opposite edge 14 is inclined downwards at the angle B relative to the horizontal. This ensures that (1) because of the sharp-edged design of the nozzle-orifice limiting edges 14/15, no water droplets can adhere to these edges, since the adhesive surface in the edge region is not sufficient for the necessary adhesion, and (2) the water droplets which form run down along the two inner walls 18/19, immediately after being formed, and are thus conveyed away.

In a preferred embodiment, the dimensions indicated in FIG. 3 have, for example, the following values:

Width A of the slit 13: 3 mm
Angle B: approximately 25°
Angle C: approximately 65°
Angle D: approximately 45°

As also emerges from FIG. 2, the inclination of the outflowing jet of steam is adjusted to that of the air stream 5 in such a way that the steam/air mixture passes into the room practically horizontally.

Tests have confirmed that when the device described is in operation the formation of water droplets is reliably prevented in the region of the edges 14 and 15. The droplets possibly forming on the inner walls 18 and 19, that is to say underneath the edges 14 and 15, run back in the direction of the arrows indicated in FIG. 3, collect in a collecting vessel located underneath and are finally conveyed away by the line 20 (FIG. 1).

A further advantage of the steam distributor described is that the entire appliance can be made practically in one piece from a plastic. The disadvantage normally associated with plastic appliances, that no subsequent evaporation takes place and severe condensation must therefore be expected, is avoided because of the special construction.

We claim:

1. A steam distributor, in an air humidification system, with a fan for generating an air stream and with at least one steam nozzle located in the effective range of this air stream and connected to a steam source, wherein the steam nozzle has at least one elongate slit, the longitudinal axis of which lies at least approximately transversely to the air flow, the longitudinally extending limiting edges of this slit each ending at an acute angle, and forming sharp edges for the purpose of preventing water drops from adhering in the region of the slit.

2. A steam distributor as claimed in claim 1, which has a continuous slit located at the bottom edge of the air outflow orifice of a housing.

3. A steam distributor as claimed in claim 1, wherein the outflow orifice of the slit is inclined at an acute angle (D) relative to the vertical.

4. A steam distributor as claimed in claim 3, wherein the two inner walls of the steam-nozzle body, which adjoin the longitudinally extending limiting edges of the slit, are inclined downwards relative to the horizontal, in such a way that the water drops forming in the edge region run off inwards.

5. A steam distributor as claimed in claim 4, wherein the said angle is practically 90° for the inner wall adjacent to the outer edge and is approximately 25° for the other inner wall located opposite it.

* * * * *